United States Patent [19]

Faulconer

[11] Patent Number: 4,778,307

[45] Date of Patent: Oct. 18, 1988

[54] BUOYANCY COMPENSATOR WITH AN ADJUSTABLE STRAP

[75] Inventor: Mark Faulconer, Costa Mesa, Calif.

[73] Assignee: U.S. Divers Company, Santa Ana, Calif.

[21] Appl. No.: 946,527

[22] Filed: Dec. 23, 1986

[51] Int. Cl.[4] ..... B63C 11/02

[52] U.S. Cl. ..... 405/186; 441/88; 441/106; 441/116; 24/197

[58] Field of Search ..... 441/88, 92, 94, 96, 441/106, 108–119; 114/315, 331, 332, 334; 405/185, 186, 187; 2/2.1 R, DIG. 3; 24/170, 197; 297/483, 484, 486, 464, 468; 244/151 R, 152; 224/211, 214, 215, 261, 262

[56] References Cited

U.S. PATENT DOCUMENTS

| | | | |
|---|---|---|---|
| 3,957,183 | 5/1976 | Gadberry | 24/197 X |
| 4,137,585 | 2/1979 | Wright, III | 441/116 X |
| 4,175,304 | 11/1979 | Bentley | 24/197 |
| 4,347,630 | 9/1982 | Aral et al. | 24/197 X |
| 4,445,253 | 5/1984 | Howey | 24/197 X |
| 4,523,914 | 6/1985 | Faulconer et al. | 441/106 X |
| 4,623,316 | 11/1986 | Ratliff | 441/118 X |
| 4,681,552 | 7/1987 | Courtney | 441/92 |

FOREIGN PATENT DOCUMENTS 967531 5/1975 Canada .

OTHER PUBLICATIONS

Sherwood Scuba advertisement, Harsco Corporation, N.Y., 12/1985, p. 12, Tusa advertisement.

Tusa advertisement, Tabata U.S.A. Inc., CA., 12/1985, pp. 14–17.

*Primary Examiner*—Galen Barefoot

*Assistant Examiner*—Paul E. Salmon

*Attorney, Agent, or Firm*—George F. Bethel; Patience K. Bethel

[57] ABSTRACT

A buoyancy compensator adjustment for a diver's buoyancy compensator having a backpack and a back portion terminating in side and shoulder portions. The shoulder portions and side portions are each secured by straps overlying the chest extending from the side portions to the shoulder portions. The straps are looped through belt loops to provide a bight under tension which is loosened upon lifting or disengaging one of the belt loops.

12 Claims, 3 Drawing Sheets

BUOYANCY COMPENSATOR WITH AN ADJUSTABLE STRAP

BACKGROUND OF THE INVENTION

1. Field of the Invention

The field of this invention lies within the buoyancy compensator art for underwater diving. In particular, it lies within the field of buoyancy compensation for divers in the form of buoyancy compensators which receive a gas therein in order to provide for buoyancy compensation at various depths.

2. The Prior Art

Prior art buoyancy compensators firstly comprised a number of buoyancy compensators in the form of chest packs that were analogous to life preservers. As time went on, buoyancy compensators took on other forms.

One particular feature of prior art buoyancy compensators was the fact that they developed the ability of being filled by oral inflation as well as power inflation. The oral inflation could be effected by means of a valve having a mouthpiece connected thereto. Upon operation of the valve, one could blow into the mouthpiece and inflate the buoyancy compensator. Also, various means for dumping gas from the buoyancy compensator were provided either through overinflation relief valves, or manually operated dumping valves.

Another development of substantial importance was power inflation through which a diver could utilize the gas in his tank in order to inflate the buoyancy compensator through a connection from the gas in the tank to the buoyancy compensator.

Other improvements have included various types of configurations, including bladders, outer coverings, arm openings, strap arrangements and other securement means.

A problem of the prior art buoyancy compensators was the adjustment of the buoyancy compensator over one's shoulders. As can be understood, buoyancy compensators relied upon shoulder straps of various configurations and attachments. Recently buoyancy compensators have incorporated a backpack attached thereto so that a diver's breathing gas tank can be held by and on the buoyancy compensator. Thus, significant loading on a diver's shoulders takes place across the shoulder straps. To date, the shoulder straps have not been easily adjustable.

This invention seeks to solve the problems with regard to adjustment of buoyancy compensators as to the straps and the loading across a user's shoulders. Accordingly, it should be viewed as a significant step over the prior art as far as the loading capability.

A further feature of this invention is the fact that most prior art backpacks incorporated metal bails, straps, or overcenter locks made of metal in order to hold a tank on the backpack. This invention incorporates an easily used fabric strap with an overcenter snapover buckle for easily securing a tank of breathing gas to the backpack of a buoyancy compensator.

SUMMARY OF THE INVENTION

In summation, this invention comprises a novel diver's buoyancy compensator with shoulder strap adjustment means and superior means for securing a tank to a diver's backpack.

More particularly, it incorporates a buoyancy compensator having filling means in the form of an oral inflation device as well as a connection for power inflation. The pressure in the buoyancy compensator is valved by an overpressure valve for relief, as well as a dumping valve.

Attached to the buoyancy compensator is a backpack having a slot for receiving a strap. The slot for receiving the strap is such wherein it allows a tank to be held to the backpack and secured in tightened connection with an overcenter buckle.

The buoyancy compensator includes a belt for adjustment around a user's waist that expands and contracts with respect to the pressure at which the belt is oriented as to depth. Also, an outer securement belt system allows for holding of the buoyancy compensator around a user's body in a relatively comfortable configuration.

The adjustable shoulder strap of the buoyancy compensator incorporates two straps looped between two buckles for adjusting the shoulder areas with respect to the waist areas. This is accomplished by an easily manipulated method of pulling the straps upwardly or downwardly depending upon the desire to either load or unload the amount of tension on the straps connected to the buoyancy compensator.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
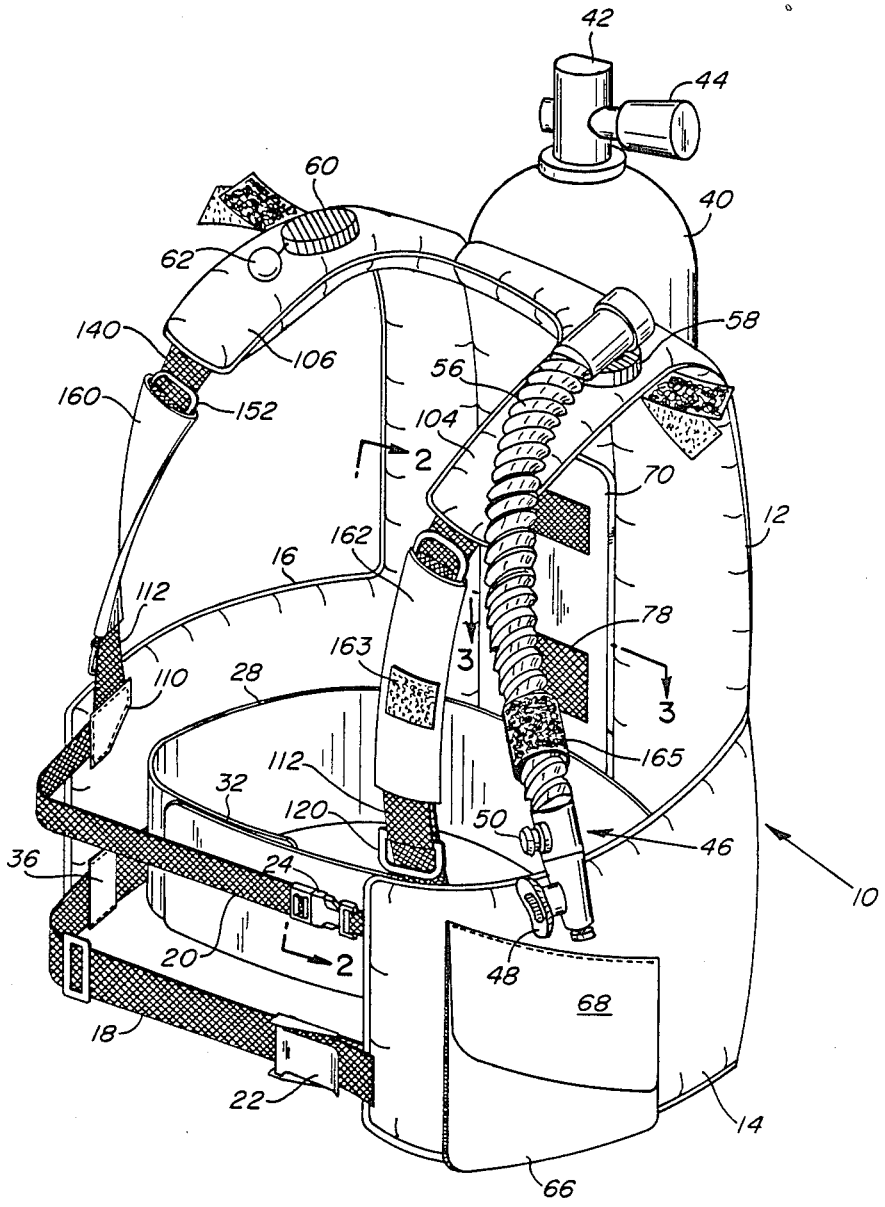
FIG. 1 shows a perspective view of the buoyancy compensator of this invention.

Looking at FIG. 1, it can be seen that a buoyancy compensator 10 is shown having a back area or portion 12 and two side areas or waist portions 14 and 16 which generally circumscribe a user's waist. The side areas or waist areas 14 and 16 are joined by a belt 18 at the bottom and a belt 20 toward the top. The two respective belts 18 and 20 are adjustable and can be linked by means of the buckles, respectively 22 and 24.

Interiorly of the back area 12 and waist areas 14 and 16 is an enlarged elastomeric belt 28 affixed by loops to belt 18. The belt 28 is formed of elastomeric foam such as wetsuit material and is joined by means of a hook and loop or pile material known under the trademark of Velcro at the front thereof in the area 32. The belt 28 is capable of expanding and contracting based upon the pressure due to the fact that it is made of a cellular foam which expands and contracts based upon pressure surrounding it in the ambient environment. The belt 28 is held to the buoyancy compensator by loops such as loop 36 attached to waist area 16 in connection with the belt 18. The belt 28 interiorly circumscribes the back 12 and waist areas 14 and 16 so as to allow for the adjustable depth compensation of the belt 28 as to its size. The compensation is caused by the elastomeric material expanding and contracting and at the same time holding the buoyancy compensator to a user's waist in snug relationship by interconnecting it with the belt 18 and loops 36.

The buoyancy compensator is made with an outer material with a bladder interiorly thereof. However, it can be made in a single walled configuration wherein the outer material serves both as the bladder and the reinforcing material holding the buoyancy compensator in its general configuration.

The buoyancy compensator has a tank 40 attached thereto. The tank 40 has a neck 42 with a valve configuration 44 for connection to a first stage regulator for regulating the gas to an intermediate pressure and providing the various intermediate pressure gases and high pressure gases for a diver.

The buoyancy compensator also incorporates an oral inflator 46 having a mouthpiece 48 and a valve button 50 for allowing one to fill the buoyancy compensator by depressing the valve button 50 and blowing into the mouthpiece 48. This causes air to be delivered through the tube 56 to an inlet fitting 58.

In addition to the foregoing features, the inflator 46 can be connected to a source of pressurized breathing gas for allowing power inflation of the interior of the buoyancy compensator.

An overinflation valve is incorporated in the fitting 58 or can be incorporated in any other place to relieve pressure upon pressure being developed within the buoyancy compensator either due to changes through ambient conditions or through overinflation by means of the power inflator. Also, a dumping valve mechanism is shown, namely, valve assembly 60. The valve assembly 60 incorporates a handle or pull member 62 for relieving pressure within the buoyancy compensator so that various pressure configurations and buoyancy can be trimmed by means of either filling or dumping gas through the dump valve 60.

A side pocket 66 is incorporated with a flap 68 for holding diving equipment therein. This is attached to the side of the buoyancy compensator and can either be stitched or held there by adhesive or formed in any other suitable manner.

Figure 3:
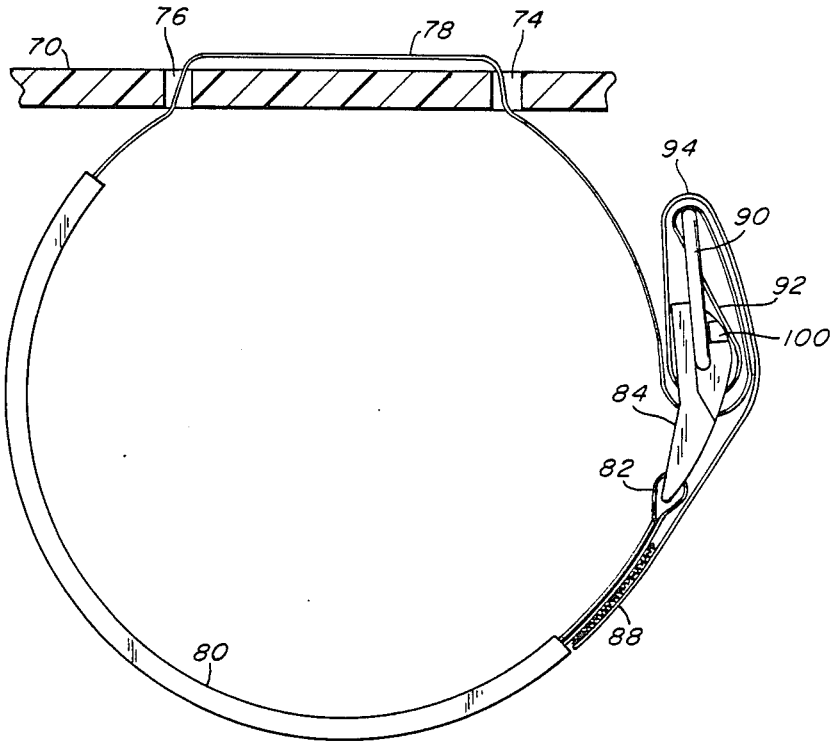
FIG. 3 shows a view of the tank securement straps as shown in the direction of lines 3—3 of FIG. 1.

The tank 40 is held to the buoyancy compensator by means of a backpack that is partially, shown, namely backpack 70. Backpack 70 as seen through lines 3—3 has been sectioned and shown in FIG. 3. The backpack allows for the tank 40 to be held on the buoyancy compensator while at the same time seating the backpack in adjoining relationship to the buoyancy compensator and holding it in situ therewith.

The backpack has slots 74 and 76 which receive a strap 78 passing therethrough. The strap 78 can be of a broad band configuration as shown in the lower area of the buoyancy compensator or it can be of a narrow band configuration shown above strap 78. The strap has a sleeve member 80 surrounding it which serves to seat against the tank 40 to hold it in place. One end of the strap, namely end 82 is looped through a buckle member 84. The strap extends from the loop 82 and terminates with a loop and pile fitting 88 known in the trade as Velcro. The strap 78 as it passes through the loop can be seen passing through a first portion and then around the end of a bail 90 of the buckle 84. The strap is then looped up under the bail 90 and extends as strap portion 92 around an internal portion of the buckle 84 and is finally looped around the end at loop 94 to extend over the top of the loops to the securement means 88 in the form of the loop and pile or Velcro attachment means for the end or tongue of the strap 78. The bail 90 is allowed to pivot upwardly and downwardly and is secured by a frictional engagement within a slot 100 so as to allow it to secure the strap 78 in a tightened configuration around the tank 40 for securing it to the backpack 70.

Figure 2:
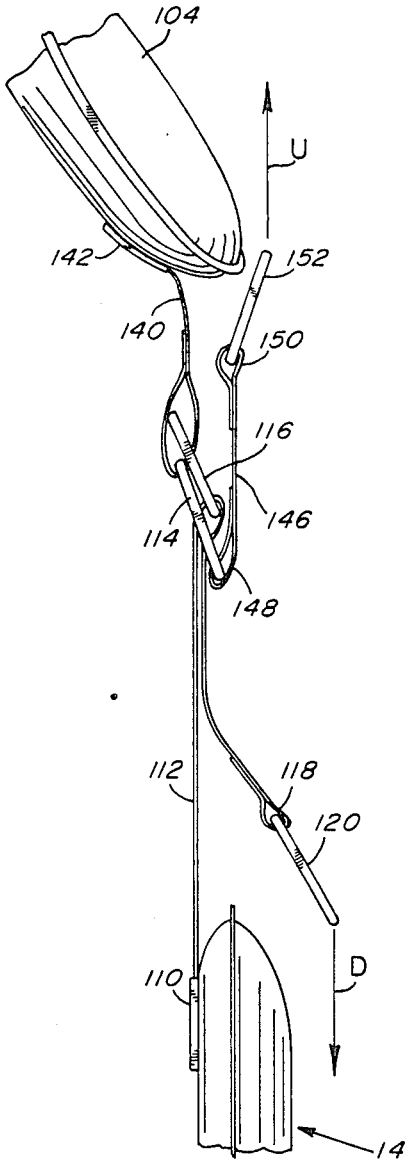
FIG. 2 shows a view of the shoulder straps in the direction of lines 2—2 with the covering sleeve removed.

Looking more particularly at FIG. 2 it can be seen wherein an upper shoulder area 104 is shown and the terminal portion of the side or waist portion 14 is shown. The upper shoulder portion 104 is matched with a second shoulder portion 106 to allow the buoyancy compensator to seat comfortably across a user's shoulders while at the same time holding the load of the tank. The shoulder portions 104 and 106 are attached respectively to the interior of the side portions of the buoyancy compensator 14 and 16 by attachment tabs 110 stitched thereto which serve to secure a belt or strap 112 to the lower portion 14 or side walls 14 and 16. Belt or strap 112 extends upwardly through a first buckle bail or eyelet 114 and around the end of a second bail or eyelet 116. Belt 112 extends downwardly again through the bail 114 terminating in a stitched loop 118 that is provided by a stitched overlapped end that receives a handle or pull in the form of a loop 120.

An upper strap or belt 140 is stitched to the shoulder member 104 and is held thereto by means of a stitching tab 142. The upper strap or belt 140 is looped around both of the ends of the eyelets, buckle or bail members 114 and 116, firstly going through the opening of the buckle member 116 and then around the end of the buckle, bail eyelet, or belt member 114. Attached at the other end of the belt or buckle member 114 is a looped portion of a belt 146. Specifically, a looped portion 148 is shown looped around the end of eyelet or buckle member 114 which terminates in a second looped handle or pull 152 shown therewith.

The looped handle 152 can be pulled upwardly for adjustment in the direction of arrow U as shown in order to loosen the entire belt and buckle configuration due to the weight of the buoyancy compensator with the load of the cylinder 40. On the other hand, when handle or loop member 120 is pulled downwardly in the direction of arrow D it tends to cinch up or tighten the relationship between the two respective belts 140 and 112 thereby bringing the shoulder area 106 into closer proximation to the side area 16 and in like manner shoulder member 104 to side area 14. It should be kept in mind that both eyelets, loops, or buckle members 114 and 116 or loop members provide free passage therethrough.

The foregoing configuration is surrounded by sleeves or covers 160 and 162. These sleeves 160 and 162 hold the respective belts and buckle members in the cinched condition so as to allow the binding of the belts and the loops 114 and 116 to operate in the manner as shown hereinbefore. However, with the sleeves 160 and 162 or any other type of member analogous to sleeves 160 and 162, the same kind of action can take place insofar as tightening by pulling downwardly on handle 120 or loosening by pulling upwardly on handle 152.

The operation of the foregoing allows the downward or loading tension on belts 140 and 112 to provide a bight through the loops 114 and 116 in engagement with the loop of the belt 112 passing therearound. Thus, any means suitable to provide a bight on the two respective belts 112 and 140 through the loops, eyelets or buckle members 114 and 116 can be utilized whether it be an overlying sleeve as shown or any other suitable means including tangs or engagement means in the buckle, loops or members 114 and 116.

It should be understood that the weight on the buoyancy compensator is usually sufficient to place a bight on the belt 112 through buckle loops or eyelets 114 and 116. Thus, the tension by the weight of the system maintains the position of the belts until the bight is relieved by handle 152 removing the bight through its upward lift to permit the loop of belt 112 to pass over eyelet 116.

Attached to sleeve 162 is a looped pile 162 which can secure a pile ring surrounding the oral inflation tube of oral inflator 165. This is in the form of Velcro attachment means 163 and 165 so as to secure the oral inflator to the sleeve 162.

Thus, in summation, in showing the action of the foregoing, a tightening of the buoyancy compensator across one's shoulders is effectuated by pulling down in the direction of Arrow D. Pulling up in the direction of Arrow U loosens the shoulder areas 104 and 106 with respect to the side panel members 14 and 16. The foregoing will be seen as an advance over the art in light of the following claims and in view of the other elements of the buoyancy compensator hereof.

I claim:

1. A buoyancy compensator for providing a diver with buoyancy comprising:

a buoyancy compensator having a front portion and a back portion for receipt of a backpack thereon upon which a tank of breathing gas can be mounted;

two side portions extending from either side of said back portion adapted to be secured at said front portion by means of a belt;

a pair of shoulder portions attached to the back portion each having a first belt extending from the shoulder portions;

a pair of first and second loop members through which the first belt passes and is looped therethrough;

a second belt extending from each of the side portions upwardly and joined to said first belt by a loop of said second belt passing through said loop members and terminating downwardly;

lifting means attached to at least one of said loop members wherein a bight is formed on said second belt when tension is applied and is loosened when said lifting means attached to said loop members is lifted upwardly to remove said bight allowing an expansion of said second belt through said loop members; and, sleeve means surrounding a portion of said second belt and said loop members in order to provide a closer relationship and a greater bight on said first and second belts.

2. The buoyancy compensator as claimed in claim 1 wherein:

the bight of said second belt passes around the second loop member and intermediately through the first loop member; and, wherein, said lifting means comprises a handle means for pulling upwardly on said first loop member.

3. The buoyancy compensator as claimed in claim 2 wherein:

said second belt terminates in a handle means for pulling said belt downwardly.

4. The buoyancy compensator as claimed in claim 1 further comprising:

an elastomeric cellular foamed belt circumscribing the interior of said buoyancy compensator interiorly of said back and side portions and attached to said back and side portions so that as a diver passes from one ambient pressure condition to another the cellular foam of said elastomeric belt will respectively expand or contract depending upon the ambient pressure condition to accommodate the expansion and contraction of the buoyancy compensator around a user's waist.

5. The buoyancy compensator as claimed in claim 4 further comprising:

a backpack fitted within said buoyancy compensator formed with slots therein;

a belt passing through said slots for passage around a tank of breathing gas adapted to be attached to said backpack; and, overcenter buckle means attached to said belt to hold said tank thereon which serves to tighten said belt around said tank.

6. the buoyancy compensator as claimed in claim 5 wherein said overcenter buckle means comprises:

a first bail; and, a buckle member attached thereto and wherein said bail is oriented to extend into a cinching mode when it is placed into a first position and which receives a loop of said belt therearound to hold said belt in a tightened position through a bight of the loop of the belt.

7. The buoyancy compensator as claimed in claim 4 further comprising:

an oral inflation means; and, a means for dumping gas from said buoyancy compensator.

8. A buoyancy compensator having a backpack attached thereto for receipt of a breathing gas tank and a back portion and two side portions with arm openings on either side thereof and wherein said back portion extends upwardly for providing two shoulder areas which receive the load on said backpack and which rests across a user's shoulders wherein the improvement comprises:

a first strap member extending from each shoulder area downwardly;

a second strap member extending upwardly from each of said side portions;

first and second loop members in approximate relationship to each other;

a loop of said first strap member passing downwardly through and around the loop members;

a bight of said second strap passing upwardly through an intermediate portion of said second loop member and over an end of said first loop member so as to create a bight between said first and second loop member;

a looped strap with a handle means extending therefrom for lifting said second loop member upwardly to remove the bight of said first and second loop members around said second strap;

handle means at the end of said second strap member for pulling downwardly on said strap member around said first and second loop members so as to increase tension between said first and second strap members and thereby tighten the relationship between said first and second strap members; and, a sleeve around at least a portion of said first and second loop members.

9. The buoyancy compensator as claimed in claim 8 further comprising:

oral inflation means.

10. The buoyancy compensator as claimed in claim 9 further comprising:

an elastomeric belt attached interiorly of said buoyancy compensator formed of elastomeric foam which can expand and contract respectively upon increases and decreases in ambient pressure conditions.

11. A buoyancy compensator belt adjustment means for a buoyancy compensator having a back portion with a packback for receipt of a breathing gas tank thereon and two side portions for extending at least partially around a user's waist and two shoulder portions extending over a user's shoulder wherein the improvement comprises:

first and second straps attached respectively to each of said shoulder portions and each of said side portions;

belt loop members connecting said first and second straps providing a bight on said second strap portion connected to said side portion;

handle means at the ends of said second strap for pulling downwardly on said second strap to increase the bight through said belt loop members for increased tension between said first and second straps;

means for removing the bight between said first and second belt loop members by pulling upwardly thereon; and wherein, said belt loop members comprise two belt loops each having an intermediate portion forming an opening therethrough;

said first strap has a loop passing between and around the intermediate portion of the first belt loop member and the end of the second belt loop member;

the bight of said second strap passes through an intermediate portion of said second belt loop member and around the end of said first belt loop member and downwardly through the opening of said second belt loop member;

handle means at the end of said second strap for pulling downwardly and decreasing the distance between said first and second straps and the attendant bight on said strap; and, a sleeve around said first and second belt loop members.

12. The buoyancy compensator as claimed in claim 11 further comprising:

an elastomeric foamed belt attached interiorly of said buoyancy compensator and which extends around a user's waist so as to compensate for various pressure differentials by attendantly expanding and contracting said elastic foamed belt thereby allowing for an expansion and contraction of the belt around a user's waist at various depths.

* * * * *